US006730449B2

(12) United States Patent
Toyama

(10) Patent No.: US 6,730,449 B2
(45) Date of Patent: May 4, 2004

(54) TONER AND IMAGE FORMING APPARATUS USING THE SAME

(75) Inventor: Hiroshi Toyama, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/372,504

(22) Filed: Feb. 24, 2003

(65) Prior Publication Data

US 2003/0170557 A1 Sep. 11, 2003

Related U.S. Application Data

(62) Division of application No. 10/003,695, filed on Dec. 6, 2001.

(30) Foreign Application Priority Data

Dec. 6, 2000 (JP) ..... 2000-371302
Dec. 6, 2000 (JP) ..... 2000-371303

(51) Int. Cl.[7] ..... G03G 9/00

(52) U.S. Cl. ..... 430/108.1; 430/111.4; 399/252

(58) Field of Search ..... 430/108.1, 111.4; 399/252

(56) References Cited

U.S. PATENT DOCUMENTS 5,098,811 A 3/1992 Anno et al.
5,766,813 A 6/1998 Kunugi
6,146,802 A * 11/2000 Okada et al. ..... 430/108.1

FOREIGN PATENT DOCUMENTS

EP 0 977 092 A2 2/2000
JP 2000-298375 * 10/2000

OTHER PUBLICATIONS

Machine Translation of JP 2000–298375.*
Patent Abstracts of Japan, JP 63 2 44 056, Oct. 11, 1988.
Patent Abstract of Japan, JP 63 027 854, Feb. 5, 1988.
Database WPI, Section CH, Week 199244, Derwent Publications Ltd., London, GB; AN 1992–360234, XP–002195131, & JP 04 260059 A (Hitachi), Sep. 16, 1992.
Database WPI, Section Ch, Week 199920, Derwent Publications Ltd., London, GB; AN 1999–236706, XP002195131 & JP 11 065174 A (Toyo Ink), Mar. 5, 1999.
Database WPI, Section Ch, Week 199830, Derwent Publications Ltd., London, GB; AN 1998–337649, XP002195132 & JP 10 123762 A (Canon), May 15, 1988.
Database WPI, Section Ch, Week 199728, Derwent Publications Ltd., London, GB; AN 1997–302661, XP002195133 & JP 09 114130 A (Tomoegawa Seishiko), May 2, 1997.

* cited by examiner

*Primary Examiner*—Mark A. Chapman
(74) *Attorney, Agent, or Firm*—Sughrue Mion, PLLC

(57) ABSTRACT

A non-magnetic mono-component toner of the present invention comprises, at least, a plurality of mother particles and a plurality of CCA particles adhering to the mother particles. The non-magnetic mono-component toner satisfies a×d<2.5, wherein "a" is the inclination of an approximation straight line of the CCA particles adhering to the mother particles, obtained by approximating distribution of particle diameter of the CCA particles relative to the particle diameter of the mother particles by the least-square method, and "d" (μm) is the volume-based mean particle diameter of the toner. Therefore, the charge on one particle of the non-magnetic mono-component toner can be efficiently reduced, thereby allowing lower developing voltage and achieving reduction in developing hysteresis.

14 Claims, 9 Drawing Sheets

(a)

(b)

Residual toner particles are peeled off so as to always allow the supply of new toner.

(a)

Because image force is so large, residual toner particles can not be completely peeled off not to allow the supply of new toner, thereby increasing the amount of charge.

(b)

TONER AND IMAGE FORMING APPARATUS USING THE SAME

This is a divisional of application Ser. No. 10/003,695 filled Dec. 6, 2001; the disclosure of which is incorporated herein by reference.

BACKGROUND OF THE INVENTION

The present invention relates to a toner for developing an electrostatic latent image formed on a latent-image carrier and to an image forming apparatus for forming an image using this toner.

More particularly, the present invention relates to a non-magnetic mono-component toner to be used for developing an image according to a non-magnetic mono-component developing method using a conductive developing roller and to an image forming apparatus using the non-magnetic mono-component toner.

Further, the present invention relates to a toner in which additive particles are entrapped in mother particles and to an image forming apparatus using this toner.

Among conventional known image forming apparatuses, there is a multicolor image forming apparatus of intermediate transfer type as shown in FIG. 1. In an image forming apparatus 1 of this type, an image is exposed to light as an electrostatic latent image onto a photoreceptor 2 as a latent image carrier. The electrostatic latent image on the photoreceptor 2 is developed by yellow, magenta, cyan, and black non-magnetic mono-component developing devices 3, 4, 5, 6 in this order (the order of respective colors is arbitrary) so as to obtain visible developed images. The developed images on the photoreceptor are superposed and toned on an intermediate transfer belt 7*a* of an intermediate transfer member 7, thus achieving primary transfer. After the primary transfer, the toned image is transferred to a recording media 9 such as a paper on a secondary transfer roller 8*a* of the transferring device 8, thus achieving secondary transfer. After that, the image is heated and fixed to the recording media 9 by a fixing device 10, thereby obtaining a desired image on the recording media 9.

The respective non-magnetic mono-component developing devices 3, 4, 5, 6 have substantially the same structure. That is, each of the developing devices 3, 4, 5, 6 is of a contact developing type that a conductive developing roller 16 is arranged in contact with the photoreceptor 2. As shown in FIG. 2(*a*), non-magnetic mono-component toner particles T in a toner container 13 are carried by a toner carrying means 14 to a toner supply roller 15 as toner supply means and is further supplied to the developing roller 16 by the toner supply roller 15. Accordingly, the non-magnetic mono-component toner particles T are held on the surface of the developing roller 16. A bias voltage composed of an alternating current superimposed on a direct current is applied to the developing roller 16 and the, developing roller 16 is rotated at a high speed, whereby the non-magnetic mono-component toner particles T are regulated to be in a uniform thin layer by a toner regulating member 17 as toner regulating means, which is in press contact with the surface of the developing roller 16, and are uniformly charged. After that, the non-magnetic mono-component toner particles T on the developing roller 16 are uniformly conveyed toward the photoreceptor 2 which is in contact with the developing roller 16.

The non-magnetic mono-component toner particles T on the developing roller 16 is transferred to the photoreceptor 2 by developing voltage applied to the developing roller 16, whereby an electrostatic latent image is developed with the non-magnetic mono-component toner particles T on the photoreceptor 2.

The non-magnetic mono-component developing method employing conductive developing roller 16 also includes a non-contact developing method in which the developing roller 16 and a photoreceptor 2 are spaced apart from each other. In developing of the non-contact developing method, a developing voltage is applied to the developing roller 16 and non-magnetic mono-component toner particles T on the developing roller 16 is transferred by jumping to the photoreceptor 2 due to the developing voltage. That is, an electrostatic latent image on the photoreceptor 2 is developed with the non-magnetic mono-component toner particles T by jumping-developing.

By the way, in the non-magnetic mono-component developing method using such a conductive developing roller 16, both cases of the non-contact development or contact development, an image force Fm acts between the non-magnetic mono-component toner particles T and the developing roller 16 as shown in FIG. 3. To securely separate the non-magnetic mono-component toner particles T from the developing roller 16 and to transfer the toner particles T to the photoreceptor 2, a coulomb force Fc capable of overcoming the image force Fm should be imparted to the non-mono-component toner particles T. Since the coulomb force Fc imparted to the non-magnetic mono-component toner particles T increases as the image force Fm increases, the developing voltage should be accordingly increased. However, too large developing voltage must cause discharge. Therefore, the developing voltage can not be increased so large. This means that the developing bias has an upper limitation. There is accordingly a problem of narrow margin for developing.

As the image force Fm is large, the effect of removing residual toner particles remaining on the developing roller 16 after developing by the toner supply roller 15 is reduced, thus facilitating producing undesirable developing hysteresis. That is, when the image force Fm is not so large, residual toner particles remaining on the developing roller 16 can be peeled off by the toner supply roller 15 as shown in FIG. 4(*a*). Therefore, the residual toner particles do not pass through spaces between the developing roller 16 and the toner supply roller 15 and thus does not move to the toner regulating means 17 side. Therefore, toner particles on the developing roller 16 between the toner supply roller 15 and the toner regulating means 17 are new non-magnetic mono-component toner particles T supplied from the toner supply roller 15 only.

On the other hand, when the image force Fm is so large, the residual toner particles can not be completely peeled off by the toner supply roller 15 as shown in FIG. 4(*b*). Therefore, some of the residual toner particles pass through spaces between the developing roller 16 and the toner supply roller 15 and thus move to the toner regulating means 17 side. Since no non-magnetic mono-component toner particle T is newly supplied from the toner supply roller 15 to portions, to which residual toner particles adhere, of the developing roller 16, the residual toner particles are carried as developer and are further charged by passing through the toner regulating means 17 so as to have larger charge. Difference in charge leads to difference in image density between a portion developed with the residual toner particles and a portion developed with new non-magnetic mono-component toner particles. That is, undesirable developing hysteresis appears.

After a solid image is printed, the amount of residual toner particles is reduced and the influence of the image force Fm is thus reduced, so none of the residual toner particles passes through spaces between the developing roller 16 and the toner supply roller 15. Therefore, non-charged new non-magnetic mono-component toner particles T, which are not charged yet, are supplied to the developing roller 16 from the toner supply roller 15 so that the non-magnetic mono-component toner particles T are suitably charged by the toner regulating means 17. However, after a white solid image is printed, the amount of residual toner particles is increased because most of the non-magnetic mono-component toner particles T are not developed, so the influence of the image force Fm is thus increased. As the image force Fm is large, some of the residual toner particles pass through spaces between the developing roller 16 and the toner supply roller 15. The residual toner particles are further charged by passing through the toner regulating means 17 so as to have larger charge. The charge of non-magnetic mono-component toner particles differs due to what type of image printed by just the last circle of the developing roller 16, particularly, solid image or white solid image. Therefore, even when printing the same pattern, density unevenness appears. That is, undesirable developing hysteresis appears.

On the other hand, a toner T conventionally used contains additive particles which are dispersed in mother particles in order to improve the characteristics of the toner or to facilitate the preparation of the toner.

For example, to stabilize the electric characteristic of the toner, a charge controlling agent called as "CCA" is dispersed as an additive in mother particles. To impart manifestation of color and/or permeability to the toner, a pigment is entrapped and dispersed as an additive in mother particles.

Further, the conventional toners are prepared by a pulverization method or polymerization method. In toners prepared by pulverization, a mold releasing agent and/or a pulverization assisting agent are kneaded with mother particles of the toner. In toners prepared by polymerization, a polymerization reaction assisting agent such as an initiator or dispersant is used as an additive for polymerization reaction.

However, some particles of such additives entrapped in mother particles of the toner may be liberated from the mother particles to become liberated additive particles. The liberated additive particles may affect the carrying property and charging property of the toner because the liberated additive particles adhere to the surface of a processing member such as the developing roller of the developing device.

For example, some particles of a CCA do not enter into mother particles during preparation of the toner so as to form liberated CCA particles liberated from the mother particles. On the other hand, the surface of the developing roller may be exposed at locations where a large amount of toner particles is consumed. As the surface of the developing roller is exposed, when new toner is supplied to the developing roller, the liberated CCA particles in the new toner adhere to the exposed surface of the developing roller. Since the liberated CCA particles have a particle diameter smaller than that of the mother particles and have a charging property stronger than that of the mother particles, once the liberated CCA particles adhere to the surface of the developing roller, the CCA particles are hardly separated from the developing roller because of image forces and intermolecular forces therebetween. Moreover, the adhering force between the liberated CCA particles and the developing roller is increased by friction created by the toner regulating member and the like.

As many liberated CCA particles adhere to the developing roller, there are differences in carrying characteristic and charging characteristic of the toner between a portion where many liberated CCA particles adhere and a portion where little liberated CCA particles adhere. There are differences in amount of toner developed on the photoreceptor between the aforementioned portions. As a result, a band-shaped unevenness of density appears on the resultant image. The adherence of the liberated CCA also shortens the lifetime of the developing device.

Therefore, it is desired to prevent liberated CCA particles from adhering to processing members such as the developing roller.

As another example, parts of pigment do not enter into mother particles during preparation of the toner so as to form pigment liberated from the mother particles. A portion of the resultant image corresponding to portion where the liberated pigment adheres to a processing member such as the developing roller should be white blank.

Further, the liberated pigment particles have a diameter larger than the pigment particles dispersed in the mother particles. Pigment functions "to impart manifestation of color" and "to impart permeability to a toner" when dispersed as micro particles in mother particles of resin. When the ratio of liberated pigment relative to entire pigment is high, the manifestation of color and the permeability may be affected. That is, poor manifestation of color leads to insufficient density and poor permeability leads to poor permeability of OHP.

Therefore, it is desired to prevent liberated pigment from adhering to the developing roller and other processing members.

Further in toners T prepared by pulverization, metallic soap is frequently kneaded as additives such as a mold releasing agent and a pulverization assisting agent together. Poor dispersion of the metallic soap leads to liberation of metallic soap particles from the mother particles. As the liberated metallic soap particles adhere to a processing member such as the developing roller, image defects such as image blurs may be produced.

Therefore, it is desired to prevent liberated metallic soap particles from adhering to processing members such as the developing roller.

Furthermore, in toners prepared by polymerization such as emulsion polymerization, a polymerization reaction assisting agent as an additive such as an initiator or dispersant may not be completely used in polymerization reaction, so a part of the polymerization reaction assisting agent not used becomes residue after dehydrating and drying processes. The residual polymerization reaction assisting agent may exist in the state liberated from the mother particles in the toner particles. The liberated polymerization reaction assisting agent facilitates coagulation of toner and thus provides poor fluidity of toner. Therefore, a predetermined carrying rate may not be obtained.

Therefore, it is desired to improve the fluidity of polymerized toner.

SUMMARY OF THE INVENTION

It is an object of the present invention to provide a non-magnetic mono-component toner which allows lower developing voltage and can achieve reduction in developing hysteresis and to provide an image forming apparatus employing the non-magnetic mono-component toner.

It is another object of the present invention to provide a toner which can further inhibit the influence of liberated additive particles even when additives are added in the mother particles and to provide an image forming apparatus employing the toner.

To achieve the aforementioned object, a non-magnetic mono-component toner of the present invention comprises, at least, a plurality of mother particles and a plurality of CCA particles which are attached to the mother particles, and is characterized by satisfying the following equation:

$$a \times d < 2.5$$

wherein "a" is the inclination of an approximation straight line of said CCA particles adhering to said mother particles, obtained by approximating distribution of particle diameter of said CCA particles relative to the particle diameter of said mother particles by the least-square method, and "d" ($\mu$m) is the volume-based mean particle diameter of said toner.

The non-magnetic mono-component toner of the present invention is characterized in that the amount of said mother particles to which no CCA particle adheres is 3.0% or less of the entire toner.

Further, the non-magnetic mono-component toner of the present invention is characterized by satisfying the following equation:

$$a \times d \geqq 1.0$$

An image forming apparatus of the present invention comprises: a latent image carrier on which an electrostatic latent image is formed; and a developing device having a conductive developing roller for carrying a non-magnetic mono-component toner to develop the electrostatic latent image on said latent image carrier, a toner supply means for supplying said non-magnetic mono-component toner to said conductive developing roller, and a toner regulating means for regulating the non-magnetic mono-component toner to be carried toward said latent image carrier and charging said non-magnetic mono-component toner, and is characterized in that said non-magnetic mono-component toner is the aforementioned non-magnetic mono-component toner of the present invention.

Further, a toner of the present invention comprises, at least, a plurality of mother particles and a plurality of additives which are added to the mother particles, and is characterized by that the liberation ratio of liberated additives liberated from said mother particles is set to be equal to or less than a specified value corresponding to the additives.

The toner of the present invention is characterized in that a CCA is used as one of said additives and the liberation ratio of the liberated CCA is set to be 1.0% or less.

Further, the toner of the present invention is characterized in that a pigment is used as one of said additives and the liberation ratio of the liberated pigment is set to be 0.6% or less.

Furthermore, the toner is a pulverized toner prepared by pulverization, and that at least one of a mold releasing agent and a pulverization assisting agent is used as one of said additives and the liberation ratio of the at least one of the mold releasing agent and the pulverization assisting agent liberated from the mother particles is set to be 0.4% or less.

Moreover, the toner of the present invention is characterized in that the toner is a polymerized toner prepared by polymerization, and that at least one of an initiator and a dispersant to be added for polymerization reaction is used as one of said additives and the liberation ratio of the at least one of the initiator and the dispersant from the mother particles is 0.3% or less.

An image forming apparatus of the present invention comprises: a latent image carrier on which an electrostatic latent image is formed; and a developing device having a conductive developing roller for carrying a toner to develop the electrostatic latent image on said latent image carrier, and a toner regulating means for regulating the toner to be carried toward said latent image carrier and charging said toner, and is characterized in that said toner is the aforementioned toner of the present invention.

In the non-magnetic mono-component toner T of the present invention having the aforementioned structure, the inclination "a" of the CCA adhering to mother particles is relatively gentle, so the concentration of the CCA is relatively low. Therefore, when the non-magnetic mono-component toner is charged by passing through the toner regulating means of the developing device, the charge of one particle of the non-magnetic mono-component toner is relatively small. In addition, the mean particle diameter "d" of the non-magnetic mono-component toner T is also relatively small so that the amount of the CCA in one particle of the non-magnetic mono-component toner, composed of one mother particle and CCA adhering to the mother particle, can be small. Similarly, the charge on one particle of the non-magnetic mono-component toner can be also small. By setting the inclination "a" of the CCA adhering to the mother particles and the mean particle diameter "d" of the non-magnetic mono-component toner T to satisfy the equation $a \times d < 2.5$, the charge on one particle of the non-magnetic mono-component toner can be efficiently reduced.

Particularly, according to the non-magnetic mono-component toner of the present invention, the amount of mother particles to which no CCA particle adheres or the amount of the asynchronous toner is set to be 3.0% or less of the entire non-magnetic mono-component toner, whereby the amount of defective charged toner particles, which are charged in the opposite polarity, can be reduced.

Further, according to the non-magnetic mono-component toner of the present invention, the aforementioned "a×d" is set to be 1.0 or more, whereby somewhat large image force can be ensured. The larger the image force is, the larger the toner carrying force is, thereby preventing toner leakage.

On the other hand, according to the image forming apparatus using the non-magnetic mono-component toner of the present invention, because the charge of one particle of the non-magnetic mono-component toner can be reduced, the image force acting between the particles of the non-magnetic mono-component toner and the developing roller can be also reduced. This allows the coulomb force Fc required for developing to be small, thus allowing the developing voltage to be small. Accordingly, in the contact developing method or the non-contact jumping developing method, a margin relative to a discharge starting voltage can be effectively obtained. Particularly, in the developing method using a bias voltage composed of AC superimposed on DC, an enough margin can be obtained.

In addition, because the image force of the non-magnetic mono-component toner is small, residual toner particles remaining on the developing roller after developing can be easily peeled off by the toner supply roller, thereby further ensuring the collection of the residual toner particles. Therefore, supplied to the developing roller between the toner regulating means and the toner supply means are new non-magnetic mono-component toner particles only, thereby reducing the developing hysteresis and also reducing the charge of the non-magnetic mono-component toner after passing through the toner regulating means.

In the toner of the present invention, the liberation ratio of librated additive is set to be equal to or less than a specified value corresponding to the additive, thereby restraining the amount of liberated additive liberated from mother particles Therefore, the probability of contact of liberated additive particles with the surfaces of processing members including the developing roller is small, thereby reducing the influence of the liberated additive on the carrying property and charging property of the toner.

Particularly, according to the toner of the present invention, the liberation ratio "h" of liberated CCA is set to be 1.0% or less. Therefore, even when the consumption of the toner is increased and the surface of the developing roller is thus exposed, the number of the liberated CCA particles is small, thereby reducing adhesion of the liberated CCA to the surface of the developing roller. Even if a few particles of the liberated CCA particles adhere to the surface of the developing roller, the progress of adhering is slower and unevenness of density due to the adhesion of the liberated CCA particles to the surface of the developing roller is not conspicuous because the particle size of the CCA particles is significantly small in comparison to the particle size of the mother particles.

Therefore, good images without unevenness due to the adhesion of the liberated CCA particles to the surface of the developing roller can be obtained over a relatively long period. The toner T of the present invention is particularly advantageous in an apparatus of which a developing device has a pressing means serving the developing roller because, in such an apparatus, adhesion of liberated CCA particles to the developing roller is promoted by the pressing means.

Moreover, if the developing roller has a rough surface, liberated CCA particles are easily caught by the rough surface, thereby promoting the adhesion of the liberated CCA particles to the developing roller. In addition, when the developing roller is conductive, the image force acting on the toner in a direction of making the toner particles to adhere to the developing roller is increased. This means that the conductivity of the developing roller also promotes the adhesion of the liberated CCA particles to the developing roller. Accordingly, the toner of the present invention is extremely effective in a developing device employing a developing roller which is made of metal and is processed by blasting.

Further, according to the toner T of the present invention, the liberation ratio "h" of liberated pigment particles is set to be 0.6% or less. Because of the small amount of the liberated pigment particles, the probability of contact of liberated pigment particles with the surfaces of processing members such as the developing roller is small, thereby almost preventing the liberated pigment particles from adhering to the surfaces of the processing member including the developing roller. Therefore, the toner T of the present invention can prevent occurrence of white blank in resultant images and reduce the influence of liberated pigment particles on the manifestation of color and permeability as the function of pigment, thus preventing the insufficiency of density, the insufficiency of permeability of OHP, and the like.

Furthermore, according to the toner of the present invention, the liberation ratio "h" of at least one of a mold releasing agent and a pulverization assisting agent which are liberated from mother particles is set to be 0.4% or less. Because of the small amount of the liberated particles of at least one of the mold releasing agent and the pulverization assisting agent, the probability of contact of liberated particles with the surfaces of processing members such as the developing roller is small, thereby almost preventing the mold releasing agent or the pulverization assisting agent from adhering to the surfaces of the processing member including the developing roller. Therefore, the toner T of this embodiment can prevent occurrence of image defects such as blurs.

Moreover, according to the toner of the present invention, the liberation ratio "h" of liberated polymerization reaction assisting agent is set to be 0.3% or less so that the amount of liberated polymerization reaction assisting agent is small, thereby making the polymerized toner hard to coagulate and thus improving its fluidity. Therefore, predetermined toner carrying rate can be reliably obtained.

On the other hand, according to the image forming apparatus of the present invention, the aforementioned toner of the present invention is used, thereby preventing liberated additive from adhering to the surfaces of the processing member including the developing roller. Therefore, the image forming apparatus of the present invention can improve the lifetime of the developing device and can provide good images over a long period.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

The embodiments of the present invention will be described hereinafter with reference to the drawings.

Figure 1:
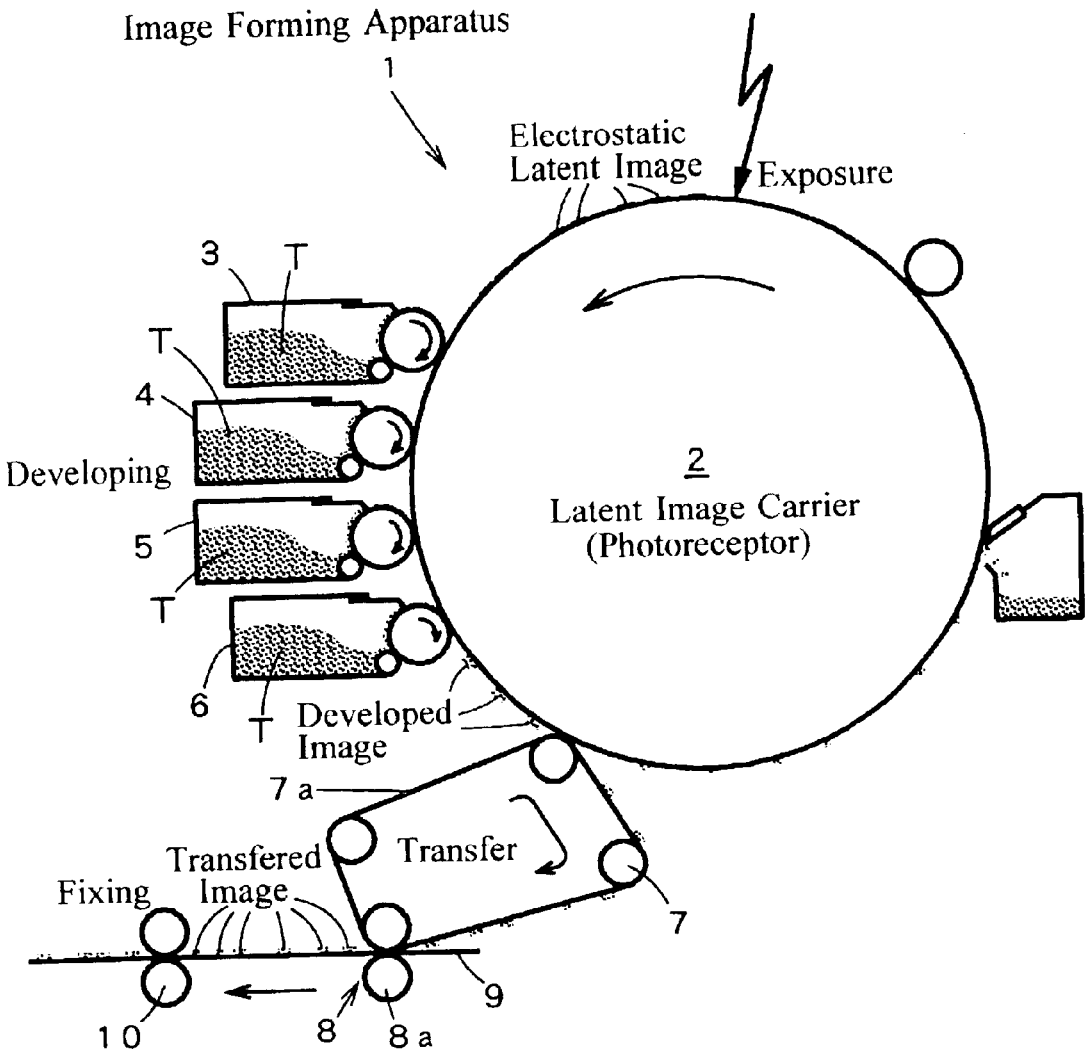
FIG. 1 is an illustration schematically showing a multicolor image forming apparatus of an intermediate transferring type, which is an example of a conventional image forming apparatus, and which is employed as an image forming apparatus according to the present invention.
Figure 2:
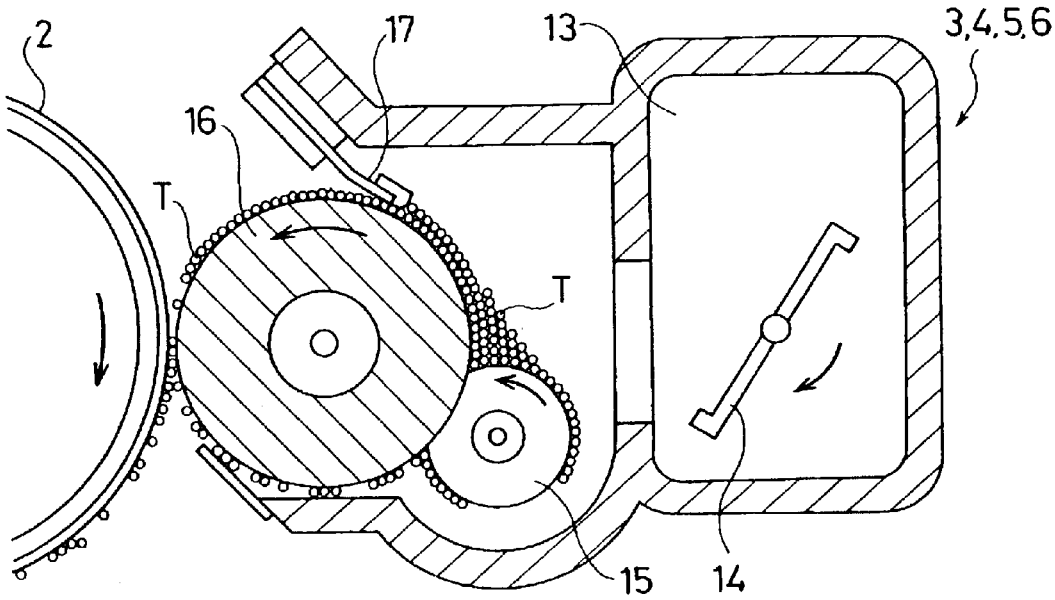
FIGS. 2(*a*) and 2(*b*) schematically show an example of a conventional developing device used in the image forming apparatus as shown in FIG. 1, wherein FIG. 2(*a*) is a sectional view thereof, and FIG. 2(*b*) is a view of one particle of a non-magnetic mono-component toner used in the image forming apparatus.
Figure 2:
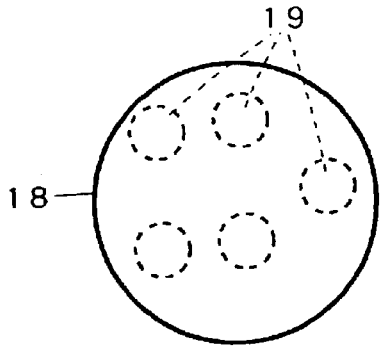
Figure 3:
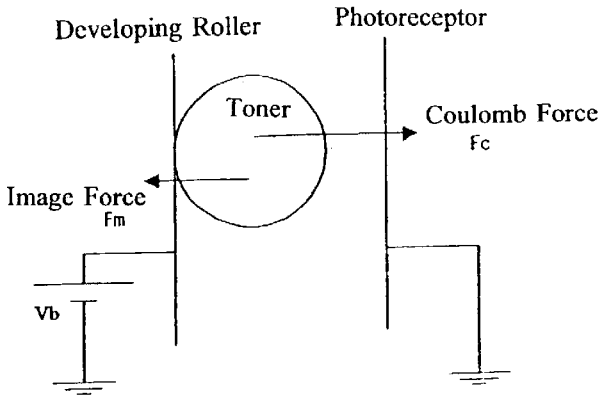
FIG. 3 is a view for explaining an image force acting on the toner particle in a non-magnetic mono-component developing method using a conductive developing roller.
Figure 4:
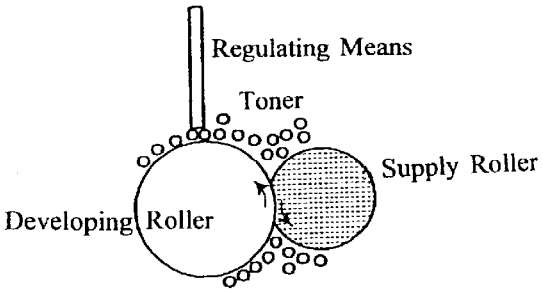
FIGS. 4(*a*) and 4(*b*) are views for explaining behavior of residual toner particles after developing, wherein FIG. 4(*a*) is a view for explaining the behavior of the toner particles when the image force is small, and FIG. 4(*b*) is a view for explaining the behavior of the toner particles when the image force is large.
Figure 4:
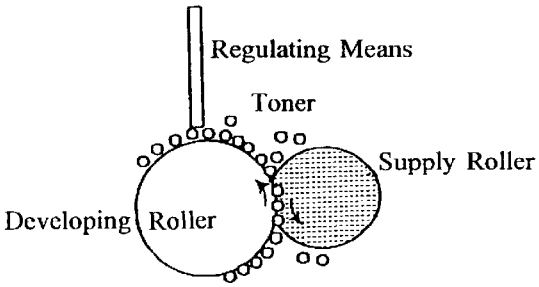

An image forming apparatus as an example of embodiments of the present invention has the same structure as shown in FIG. 1 and FIG. 2(*a*). Therefore, actions for forming an image of the image forming apparatus of this embodiment are the same as those of the aforementioned conventional apparatus.

As shown in FIG. 2(*b*), a non-magnetic mono-component toner T used in the image forming apparatus of this embodiment has a plurality of CCA particles 19 contained in mother particles 18. The non-magnetic mono-component toner T of this embodiment satisfies the following equation:

$$a \times d < 2.5$$

wherein "a" is the inclination of an approximation straight line obtained by approximating distribution of particle diameter of said CCA particles 19 adhering to the mother particles 18 relative to the particle diameter of said mother particles 18 by the least-square method the particle diameter and "d" ($\mu$m) is the volume-based mean particle diameter of the mother particles 18.

To obtain the inclination "a" of the approximation straight line for the CCA particles 19 adhering to the mother particles 18, it is necessary to analyze the state of adhesion between the mother particles 18 and the CCA particles (hereinafter, sometimes referred to "synchronized CCA" as will be described) 19. There are several conventional methods for analyzing toners. The image forming apparatus 1 according to this embodiment employs, for instance, a particle analyzing method as will be expressed as follows. A method of analyzing the state of adhesion between mother particles and external additive particles by using a particle analyzing method is disclosed in "A New Approach for the Additive Material Analysis—The Toner Measurement by Particle Analyzer—", Toshiyuki Suzuki and Toshio Takahara, collection of "Japan Hardcopy '97", the (95th) annual conference of the society of electrophotography of Japan, sponsored by the society of Electrophotography, Jul. 9–11, 1997. Though description of details of the particle analyzing method are here omitted, just simple description will be made.

Figure 5:
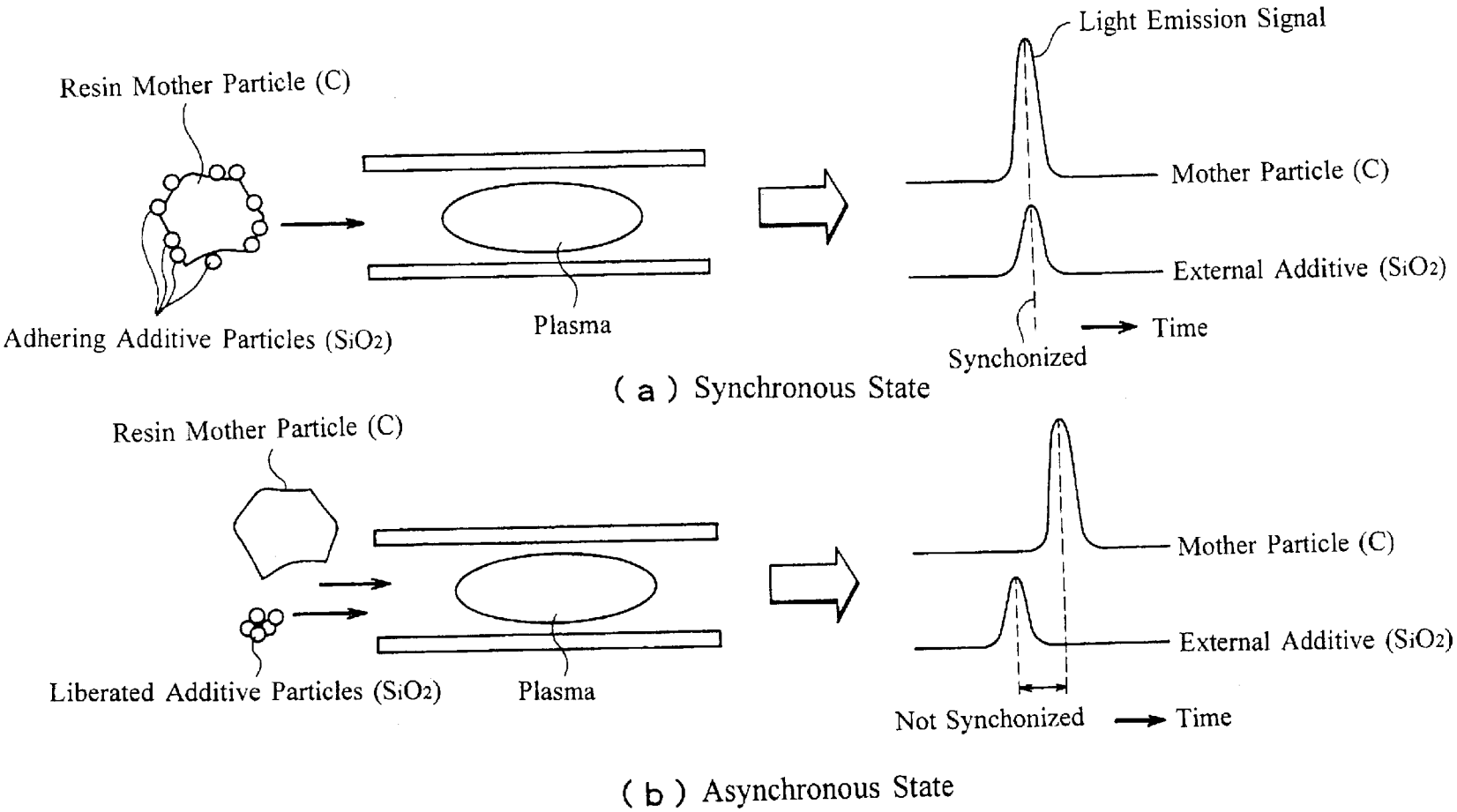
FIGS. 5(*a*) and 5(*b*) are views for explaining an example of a conventional toner analyzing method for analyzing a state of adhesion between mother particles of toner and external additive particles.

This analyzing method is an elementary analyzing method comprising the steps of introducing toner particles T, containing external additive particles consisting of silica ($SiO_2$) adhering to the surfaces of mother particles (C) made of a resin, into plasma so as to excite the toner particles T and of obtaining emission spectrum as shown in FIGS. 5(*a*) and 5(*b*) owning to the excitation.

In the views shown in FIGS. 5(*a*), 5(*b*), an axis of abscissa showing emission spectrum stands for time axis. As shown in FIG. 5(*a*), introduction of toner particles T, in which external additive particles ($SiO_2$) adhere to mother particles (C) made of a resin of the toner T, into plasma causes both of the mother particles (C) and the external additive particles ($SiO_2$) to emit light. Since the mother particles (C) and the external additive particles ($SiO_2$) are simultaneously introduced into plasma, the mother particles (C) and the external additive particles ($SiO_2$) simultaneously emit light. The state in which the mother particles (C) and the external additive particles ($SiO_2$) simultaneously emit light is equal to the state in which the mother particles (C) and the external additive particles ($SiO_2$) are synchronized with each other. Namely, the state in which the mother particles (C) and the external additive particles ($SiO_2$) are synchronized with each other stands for the state in which the external additive particles ($SiO_2$) adhere to the mother particles (C).

In a state as shown in FIG. 5(*b*) in which mother particles (C), to which no external additive particles ($SiO_2$) adheres, and external additive particles ($SiO_2$) liberated from the mother particles (C) are introduced into plasma, both of the mother particles (C) and the external additive particles ($SiO_2$) emit light similarly to the aforementioned case. However, since the mother particles (C) and the external additive particles ($SiO_2$) are introduced into plasma at different times, the mother particles (C) and the external additive particles ($SiO_2$) emit light at different times (for instance, when the mother particles are introduced into plasma prior to the introduction of the external additive particles, the mother particles first emit light, and then the external additives emit light).

The state in which the mother particles (C) and the external additive particles ($SiO_2$) emit light at different times is equal to the state in which the mother particles (C) and the external additive particles ($SiO_2$) are not synchronized with each other (that is, an asynchronous state). Namely, the state in which the mother particles (C) and the external additive particles ($SiO_2$) are asynchronous with each other stands for a state in which the external additive particles ($SiO_2$) do not adhere to the mother particles (C).

Figure 6:
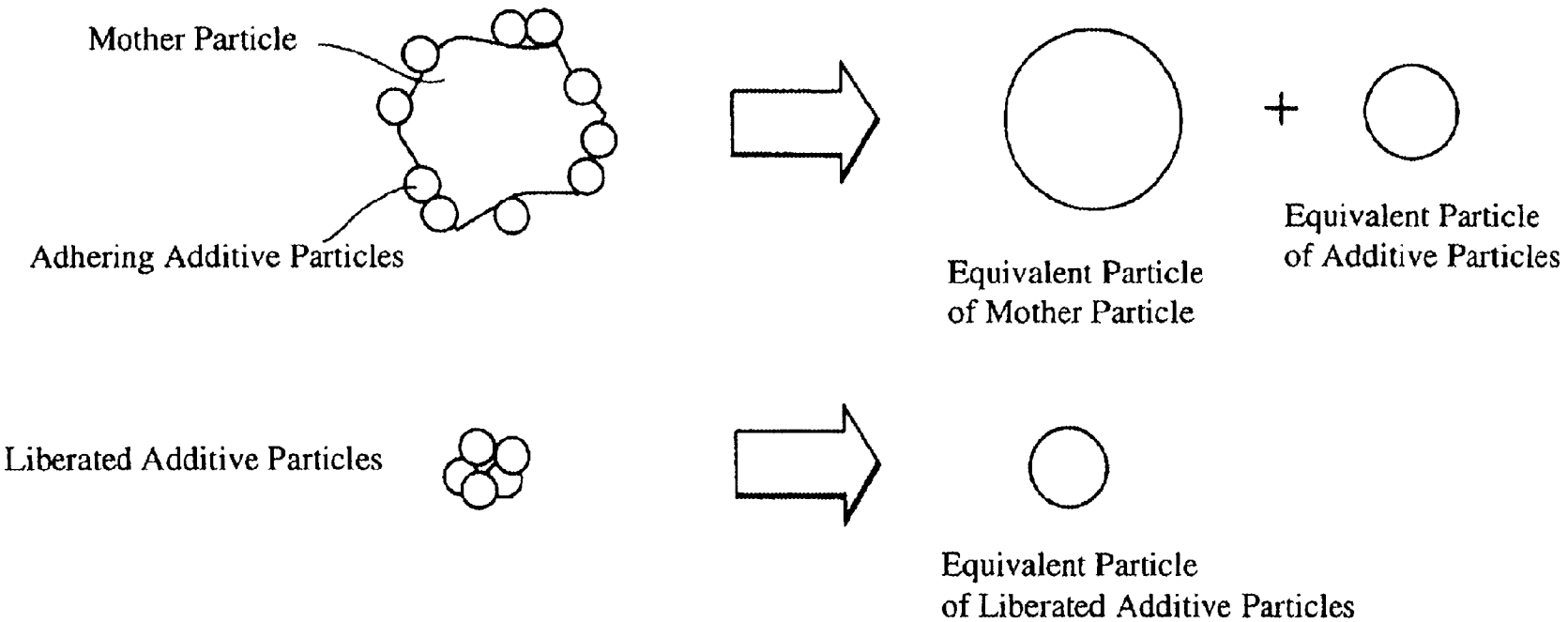
FIG. 6 is a view showing equivalent particles and equivalent particle diameters for use in the toner analyzing method shown in FIGS. 5(*a*), 5(*b*)

Referring to FIGS. 5(*a*), 5(*b*), the height of the light emission signal indicates the intensity of emitted light. The intensity of emitted light is proportional to the number of atoms (C and $SiO_2$) of the elements contained in the particles, not the size and shape of the particles. To express the intensity of emitted light of the elements into the sizes of the particles, each mother particle (C) is assumed as a perfect sphere and adhering external additive particles ($SiO_2$) are assumed together as a perfect sphere during light emission as shown in FIG. 6. Thus, the intensity is expressed by the particle diameter of the mother particles (C) and the particle diameter of the external additive particles ($SiO_2$). The perfect spheres are called equivalent particles, and the particle diameter of each equivalent particle is called an equivalent particle diameter. Since the external additive particles having very small sizes cannot individually be detected, the detected light emission signals of the external additive particles are added together to be converted into one equivalent particle for analysis.

Figure 7:
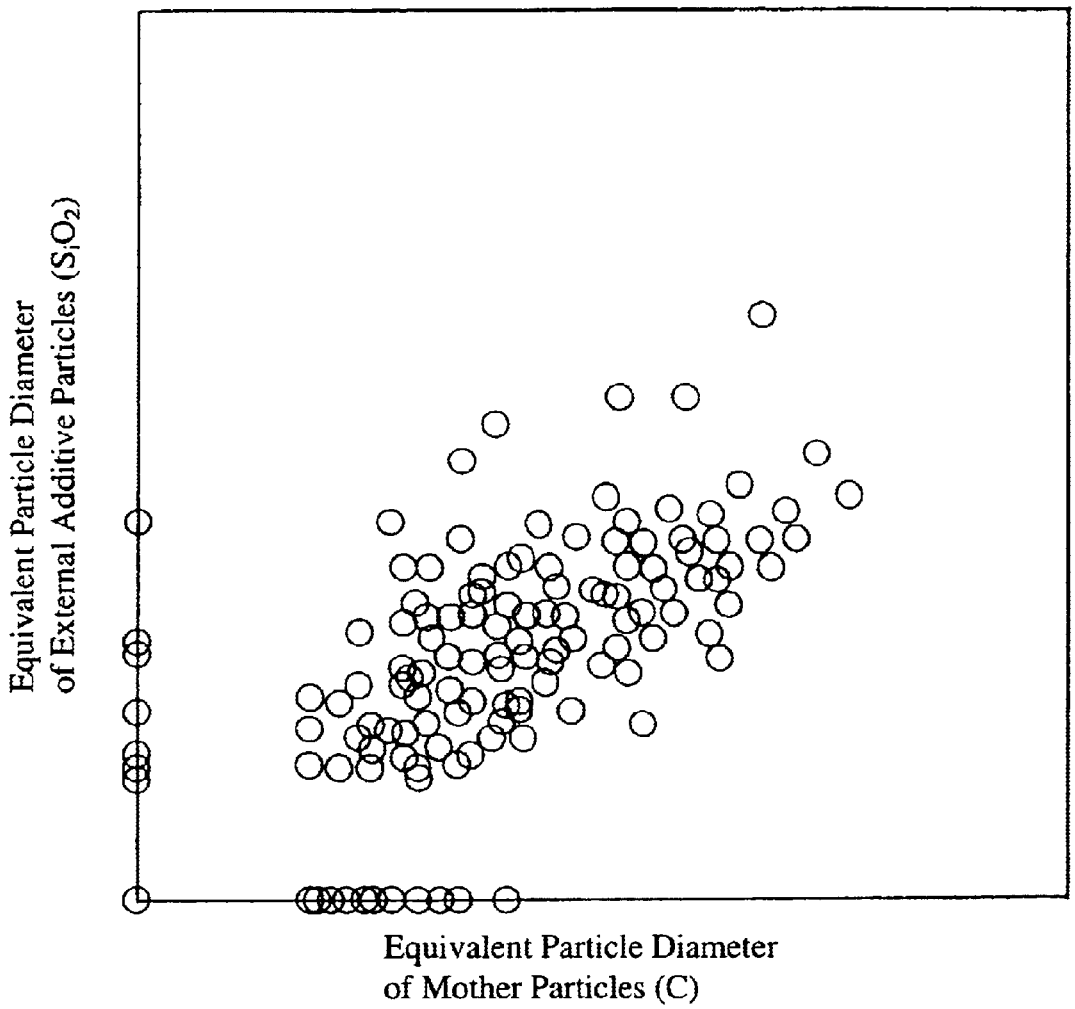
FIG. 7 is a graph showing results of analysis performed with the toner analyzing method shown in FIGS. 5(*a*), 5(*b*)

The equivalent particle diameter of the equivalent particle obtained from the respective emission spectrum of the mother particles and the external additive particles is plotted for each toner particle T, whereby a graph showing the distribution of equivalent particle diameters of the toner particles as shown in FIG. 7 is obtained.

In the graph shown in FIG. 7, an axis of abscissa stands for equivalent particle diameters of the mother particles (C) and an axis of ordinate which stands for equivalent particle diameter of the external additive particles ($SiO_2$). The equivalent particles indicated on the axis of abscissa represent asynchronous mother particles (C) to which no external additive particles ($SiO_2$) adhere. In this case, mother particles (C) to which external additive particles having concentration less than the predetermined additive concentration adhere are also indicated on the axis of abscissa. On the other hand, the equivalent particles indicated on the axis of ordinate represent asynchronous external additive particles ($SiO_2$) liberated from the mother particles (C). Equivalent particles deviated from the axis of abscissa and the axis of ordinate indicate synchronized toner particles T having the external additive particles ($SiO_2$) adhering the mother particles (C).

Thus, the state of adhesion of the external additive particles ($SiO_2$) to the mother particles (C) of the toner T is analyzed. It should be understood that any other analyzing method may be employed as the toner analyzing method besides the particle analyzing method.

Figure 8:
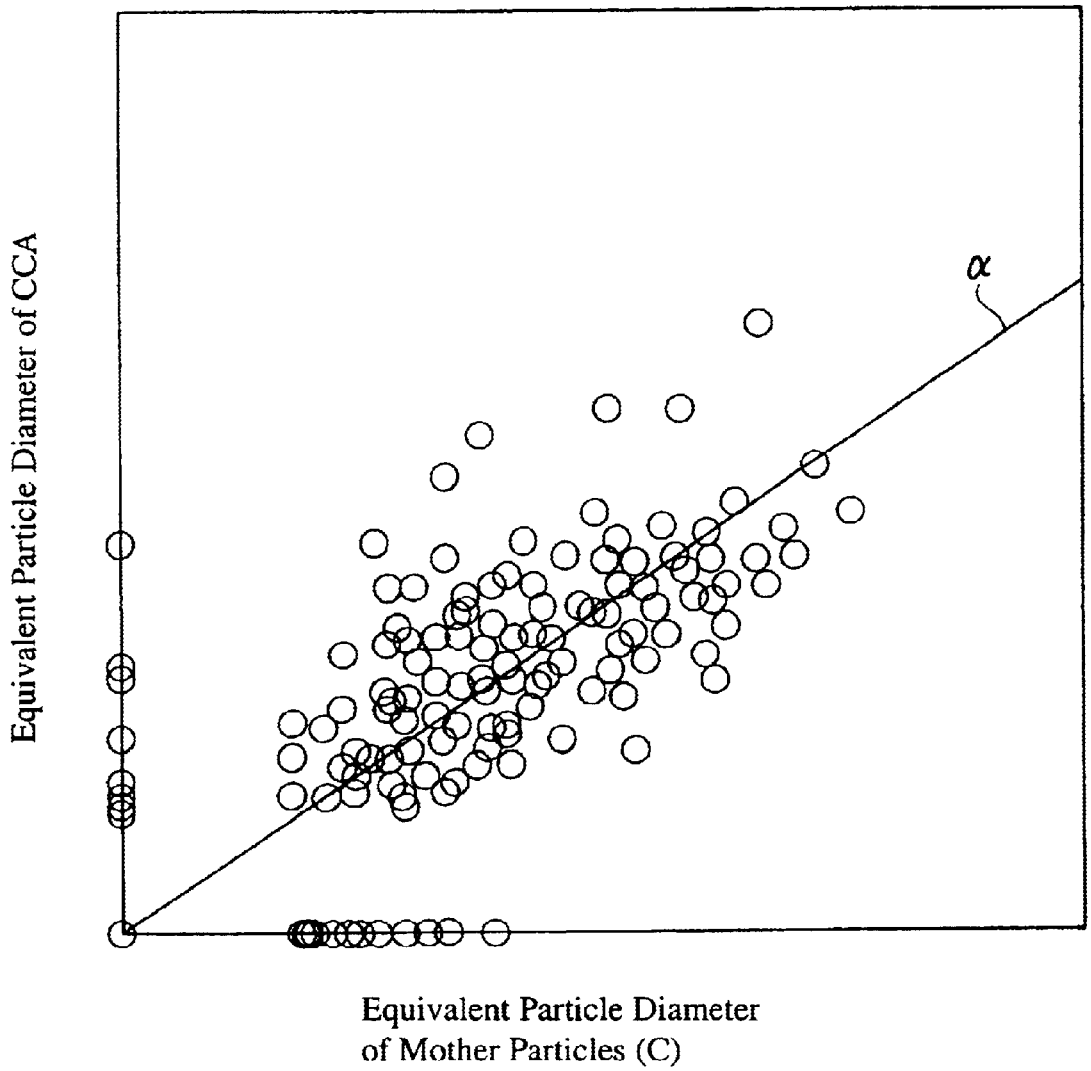
FIG. 8 is a graph showing a state of adhesion between mother particles and CCA particles of toner as a result obtained in the same manner as the analysis shown in FIG. 7, wherein the graph includes an approximation straight line (a passing through the origin according to the least-square method.

In the image forming apparatus 1 of this embodiment of the present invention, the state of adhesion of CCA particles 19 as one of the external additives to the mother particles (C) is analyzed by using the particle analyzing method. That is, according to the present invention, as shown in FIG. 8, a distribution map indicating equivalent particle diameters of the non-magnetic mono-component toner particles is prepared with regard to the CCA particles 19 similarly to the distribution map indicating equivalent particle diameters of the toner particles shown in FIG. 7. By using this map, an approximation straight line $\alpha$ passing through the origin is obtained by the least-square method and the inclination (equivalent particle diameter of the CCA particles/equivalent particle diameter of the mother particles) "a" of the approximation straight line $\alpha$ is also obtained for representing the state of adhesion between carbon (C) in the mother particles and the CCA 19 of the non-magnetic mono-component toner T. The inclination "a" of the approximation straight line a synchronizes to the mother particles (C). Accordingly, the inclination "a" indicates the concentration of the of the CCA 19 adhering to (synchronized with) the mother particles (C). That is, the gentler the inclination "a" is, the smaller the amount of the synchronized CCA 19 is. The sharper the inclination "a" is, the larger the amount of the synchronized CCA 19 is.

In the non-magnetic mono-component toner T of this embodiment having the aforementioned structure, the inclination "a" of the CCA 19 adhering to mother particles 18 is relatively gentle, so the concentration of the CCA 19 is relatively low. Therefore, when the non-magnetic mono-component toner T is charged by passing through the toner regulating means of the developing device, the charge on one particle of the non-magnetic mono-component toner T is relatively small. In addition, the mean particle diameter "d" of the non-magnetic mono-component toner T is also relatively small so that the amount of the CCA 19 in one particle of the non-magnetic mono-component toner T, composed of one mother particle 18 and CCA 19 adhering to the mother particle, is small. Similarly, the charge on one particle of the non-magnetic mono-component toner T is also small. By setting the inclination "a" of the CCA 19 adhering to the mother particles 18 and the mean particle diameter "d" of the non-magnetic mono-component toner particles T to satisfy the aforementioned equation, the charge on one particle of the non-magnetic mono-component toner T can be efficiently reduced.

In the image forming apparatus 1 using this non-magnetic mono-component toner T, because the charge of one particle of the non-magnetic mono-component toner T can be reduced, the image force Fm acting between the particles of the non-magnetic mono-component toner T and the developing roller 16 can be also reduced. This allows the coulomb force Fc required for developing to be small, thus allowing the developing voltage to be small. Accordingly, in the contact developing method or the non-contact jumping developing method, a margin relative to a discharge starting voltage can be effectively set. Particularly, in the developing method using a bias voltage composed of AC superimposed on DC, an enough margin can be set.

In addition, because the image force Fm of the non-magnetic mono-component toner T is small, residual toner particles remaining on the developing roller 16 after developing can be easily peeled off by the toner supply roller 15, thereby further ensuring the collection of the residual toner particles. Therefore, supplied to the developing roller 16 between the toner regulating means 17 and the toner supply roller 15 are new non-magnetic mono-component toner particles T only, thereby reducing the developing hysteresis and also reducing the charge of the non-magnetic mono-component toner T after passing through the toner regulating member 17.

Actually, experiments for measurements of jumping starting voltage (V) and hysteretic density (OD value) were conducted as for non-magnetic mono-component toners of Examples 1 and 2 of the present invention and also non-magnetic mono-component toners of Comparative Examples 1 and 2 for comparison to Examples 1 and 2. The experiments were conducted by the non-contact developing method in which the gap between the developing roller 16 and the photoreceptor 2 was set 300 $\mu$m.

(1) Measurement and Evaluation of Jumping Starting Voltage

Developing voltage was gradually increased to measure a voltage when the non-magnetic mono-component toner jumps to the photoreceptor 2. When the voltage was 600V or more, "No Good (N.G.)" was given for evaluation.

(2) Evaluation of Developing Hysteretic Density

After printed solid images and white solid images, the difference in line image density (OD value) at 50% duty cycle was measured. When the difference in line image density was 0.1 or more, the developing hysteresis was very conspicuous so that "No Good (N.G.)" was given for evaluation.

The results of the experiments are shown in Table 1.

TABLE 1

| | Inclination a | Volume-based mean particle diameter "d" ($\mu$m) | a × d | Jumping starting voltage (V) | Difference in developing hysteretic density (OD value) | Evaluation |
|---|---|---|---|---|---|---|
| Example 1 | 0.25 | 8.0 | 2.00 | 510 | 0.04 | Good |
| Example 2 | 0.35 | 7.0 | 2.45 | 550 | 0.07 | Good |
| Comparative Example 1 | 0.35 | 8.0 | 2.80 | 860 | 0.14 | N.G. |
| Comparative Example 2 | 0.25 | 11.0 | 2.75 | 850 | 0.13 | N.G. |

As apparent from Table 1, the non-magnetic mono-component toners of Examples 1 and 2 belonging to the present invention had good results that the jumping starting voltage of the non-magnetic mono-component toner is smaller than 600V and the difference in developing hysteretic density (OD value) is smaller than 0.1. On the other hand, the non-magnetic mono-component toners of Comparative Examples 1 and 2 not belonging to the present invention had no-good results that the jumping starting voltage of the non-magnetic mono-component toner is more than 600V and the difference in developing hysteretic density (OD value) is more than 0.1.

In a variation of non-magnetic mono-component toner T of the present invention, the amount of mother particles 18 without CCA 19 therein (hereinafter, sometimes referred to as "asynchronous toner") is set to be 3.0% or less of the entire non-magnetic mono-component toner.

By setting the asynchronous toner to be 3.0% or less of the entire non-magnetic mono-component toner, the amount of defective charged toner particles, which are charged in the opposite polarity, can be reduced.

Experiments for measurement of the amount of defective charged toner particles were conducted as for a non-magnetic mono-component toner of Variation Example 1 according to the variation of the present invention and a non-magnetic mono-component toner of Variation Comparative Example 1 for comparison to Variation Example 1. The experiments are conducted by the non-contact developing method similarly to the aforementioned experiments. The evaluation for the defective charged toner particles was conducted as follows. White solid images were printed on 1000 sheets of paper, of which size was A4. The weight of a developing cartridge was measured before and after the printing. Since the reduced weight corresponded to the amount of toner particles fogging on the photoreceptor because the toner particles were charged in the opposite polarity, the fogging amount was obtained from the measured reduced weight. If the fogging amount exceeds a constant value (for instance, 3.0 g), "No Good (N.G.)" was given for evaluation.

The results of the experiments are shown in Table 2.

TABLE 2

| | Toner without CCA | Fogging amount | Evaluation |
|---|---|---|---|
| Variation Example 1 | 2.5% | 1.5 g | Good |
| Variation Comparative Example 1 | 4.0% | 6.0 g | N.G. |

As apparent from Table 2, the non-magnetic mono-component toner of Variation Example 1 belonging to the present invention had a good result that the fogging amount of toner is smaller than 3 g. On the other hand, the non-magnetic mono-component toner of Variation Comparative Example 1 not belonging to the present invention had a no-good result that the fogging amount of toner is more than 3 g.

In another variation of non-magnetic mono-component toner T of the present invention, the inclination "a" with respect to CCA 19 adhering to mother particles 18 and the volume-based mean particle diameter "d" of the mother particles 18 are set to satisfy the following equation:

$$1.0 \leqq a \times d.$$

By setting "a×d" to be 1.0 or more, somewhat large image force Fm can be ensured. The larger the image force Fm is, the larger the toner carrying force is, thereby preventing toner leakage.

Experiments for measurement of the carrying force were conducted as for a non-magnetic mono-component toner of Variation Example 2 according to this variation of the present invention and a non-magnetic mono-component toner of Variation Comparative Example 2 for comparison to Variation Example 2. The evaluation for the toner carrying force was conducted as follows. First, a developing cartridge was singly run idle. Then, the carrying amount was gradually increased to measure a carrying amount immediately before leakage of toner. If the carrying amount measured was less than 0.4 mg/cm$^2$, "No Good (N.G.)" was given for evaluation.

The results of the experiments are shown in Table 3.

TABLE 3

| | a × d | Maximum carrying amount | Evaluation |
|---|---|---|---|
| Variation Example 2 | 1.2 | 0.48 mg/cm$^2$ | Good |
| Variation Comparative Example 2 | 0.8 | 0.36 mg/cm$^2$ | N.G. |

As apparent from Table 3, the non-magnetic mono-component toner of Variation Example 2 belonging to the present invention had a good result that the maximum carrying amount of toner was more than 0.4 mg/cm$^2$. On the other hand, the non-magnetic mono-component toner of Variation Comparative Example 2 not belonging to the present invention had a no-good result that the maximum carrying amount of toner was less than 0.4 mg/cm$^2$.

It should be noted that the present invention is not limited to the aforementioned image forming apparatus shown in FIG. 1 and FIG. 2(*a*) and may be applied to any image forming apparatus which can accept the toner T of the present invention.

As apparent from the above description, according to the non-magnetic mono-component toner of the present invention, the inclination "a" of CCA adhering to mother particles is relatively gentle, that is, the concentration of the CCA is relatively low. Therefore, when the non-magnetic mono-component toner T is charged by passing through the toner regulating means of the developing device, the charge on one particle of the non-magnetic mono-component toner T can be relatively small. In addition, the mean particle diameter "d" of the non-magnetic mono-component toner T is also relatively small so that the amount of the CCA in one particle of the non-magnetic mono-component toner T, composed of one mother particle and CCA adhering to the mother particle, can be small. Similarly, the charge on one particle of the non-magnetic mono-component toner T can be also small. By setting the inclination "a" of the CCA adhering to the mother particles and the mean particle diameter "d" of the non-magnetic mono-component toner T to satisfy the aforementioned equation, the charge on one particle of the non-magnetic mono-component toner T can be efficiently reduced.

Particularly, according to the non-magnetic mono-component toner of the present invention, the amount of mother particles to which no CCA particle adheres or the amount of the asynchronous toner is set to be 3.0% or less of the entire non-magnetic mono-component toner, whereby the amount of defective charged toner particles, which are charged in the opposite polarity, can be reduced.

Further, according to the non-magnetic mono-component toner of the present invention, the aforementioned "a×d" is set to be 1.0 or more, whereby somewhat large image force can be ensured. The larger the image force is, the larger the toner carrying force is, thereby preventing toner leakage.

On the other hand, according to the image forming apparatus using the non-magnetic mono-component toner of the present invention, because the charge of one particle of the non-magnetic mono-component toner can be reduced, the image force acting between the particles of the non-magnetic mono-component toner and the developing roller can be also reduced, thereby allowing the developing voltage to be small. Accordingly, in the contact developing method or the non-contact jumping developing method, a margin relative to a discharge starting voltage can be effectively obtained. Particularly, in the developing method using a bias voltage composed of AC superimposed on DC, an enough margin can be obtained.

In addition, because the image force of the non-magnetic mono-component toner is small, residual toner particles remaining on the developing roller after developing can be easily peeled off by the toner supply roller, thereby further ensuring the collection of the residual toner particles. Therefore, new non-magnetic mono-component toner particles can be supplied to the developing roller, thereby reducing the developing hysteresis and also reducing the charge of the non-magnetic mono-component toner after passing through the toner regulating means.

Figure 9:
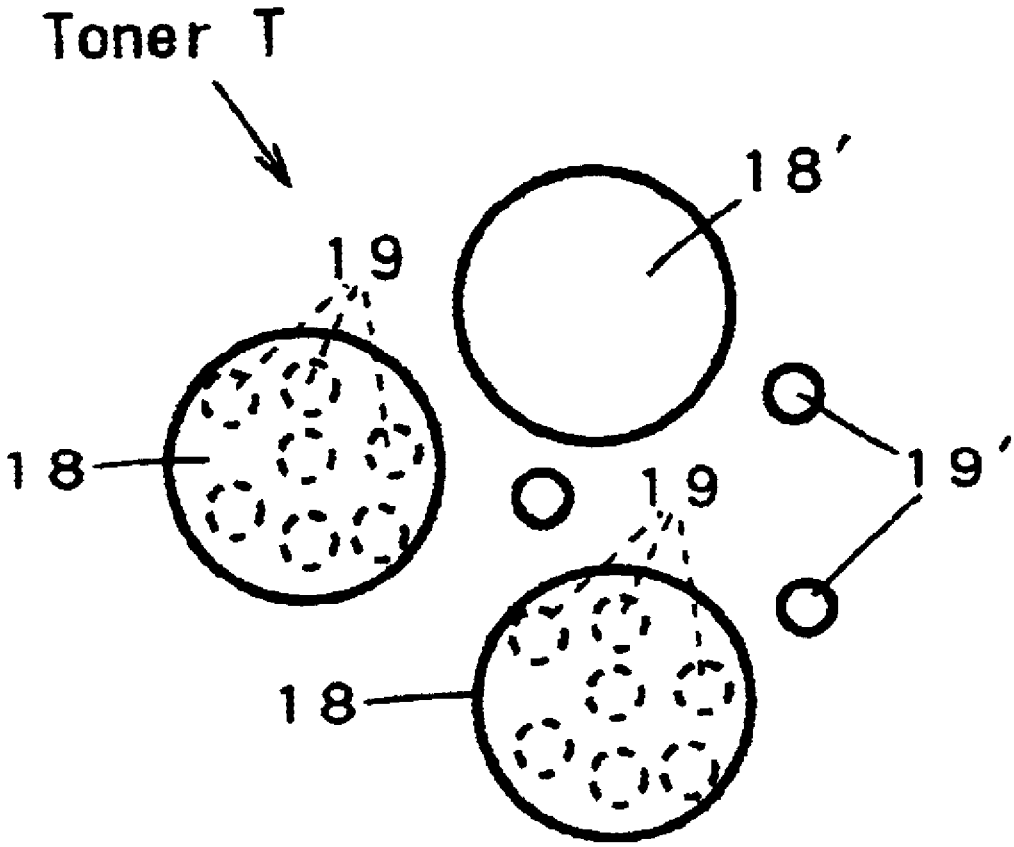
FIG. 9 is a partially enlarged view showing another embodiment of toner according to the present invention.

FIG. 9 is a partially enlarged view showing another embodiment of toner according to the present invention.

The toner T of this embodiment comprises, at least, mother particles 18 having a plurality of additive particles 19 entrapped therein and dispersed in resin thereof as shown in FIG. 9, mother particles 18' having no additive particle 19 therein, and additive particles 19' (hereinafter, sometimes called as "liberated particles 19') liberated from any mother particle 18. In this toner T, CCA is employed as one of additives 19 and the ratio of liberated CCA particles (that is, CCA particles liberated from any mother particle 18), i.e. the liberation ratio "h", is set to be 1.0% or less relative to the entire toner.

To analyze the liberation ratio of the liberated CCA in the toner T, it is required to measure the amounts of the respective components of the toner T: the mother particles 18 having CCA particles therein, the mother particles having no CCA particle therein, and the liberated CCA particles. Some conventional methods can be used for such analysis. In the image forming apparatus of this embodiment, the aforementioned particle analyzing method is employed.

Thus, the state of adhesion of the external additive ($SiO_2$) relative to the mother particles (C) of the toner T is analyzed. It should be understood that any other analyzing method may be employed as the toner analyzing method besides the particle analyzing method.

In the image forming apparatus 1 of this embodiment of the present invention, the number of the mother particles 18 having CCA particles therein, the number of the mother particles having no CCA particle therein, and the number of the liberated CCA particles are counted by using this particle analyzing method, thereby analyzing the rate of liberated CCA particles. In this case, assuming that the counted number of the mother particles 18 having CCA particles therein is "e", the counted number of the mother particles having no CCA particle therein is "f", the counted number of the liberated CCA particles is "g", and the ratio of the liberated CCA particles is "h(%)", the liberation ratio "h" of the liberated CCA is obtained by the following equation:

$$h=\{g/(e+f+g)\}\times 100(\%).$$

Since the CCA particles are entrapped in the mother particles 18, it is considered that the CCA particles are hard to be liberated from the mother particles 18 and it is comparatively difficult to analyze the liberated CCA particles. However, the aforementioned toner analyzing method by using a particle analyzer is employed, thereby achieving further reliable and easier analysis.

In the toner T of this embodiment, the liberation ratio "h" of the liberated CCA particles is set to be 1.0% or less. Therefore, even when the consumption of the toner is increased and the surface of the developing roller 16 is thus exposed, the probability of contact of liberated CCA particles with the surface of the developing roller 16 is small because the number of the liberated CCA particles is small, thereby almost preventing the liberated CCA particles from adhering to the surface of the developing roller 16. Even if there is some liberated CCA particles and a few particles of this some liberated CCA particles adhere to the surface of the developing roller 16, the progress of adhering is slower and unevenness of density due to the adhesion of the liberated CCA particles to the surface of the developing roller 16 is not conspicuous because the particle size of the CCA particles is significantly small in comparison to the particle size of the mother particles 18.

Therefore, by using the toner T of this embodiment, the image forming apparatus 1 of the present invention can provide good images without unevenness due to the adhesion of the liberated CCA particles to the surface of the developing roller 16 over a relatively long period. In addition, the lifetime of the developing device of the image forming apparatus 1 can be increased by using the toner T.

The toner T of the present invention is particularly advantageous in an apparatus of which a developing device has a pressing means serving the developing roller 16 because, in such an apparatus, adhesion of liberated CCA particles to the developing roller 16 is promoted by the pressing means. Therefore, the toner T of the present invention can significantly prevent the adhesion of liberated CCA particles especially in an image forming apparatus of a type in which the toner particles T are regulated to be in a thin layer by a toner regulating member 17 as the pressing means to the developing roller 16.

Moreover, if the developing roller 16 has a rough surface, liberated CCA particles are easily caught by the rough surface, thereby promoting the adhesion of the liberated CCA particles to the developing roller 16. In addition, when the developing roller 16 is conductive, the image force acting on the toner T in a direction of making the toner particles to adhere to the developing roller 16 is increased. This means that the conductivity of the developing roller 16 also promotes the adhesion of the liberated CCA particles to the developing roller 16. Accordingly, the toner of the present invention is extremely effective in a developing device employing a developing roller 16 which is made of metal and is processed by blasting.

Figure 10:
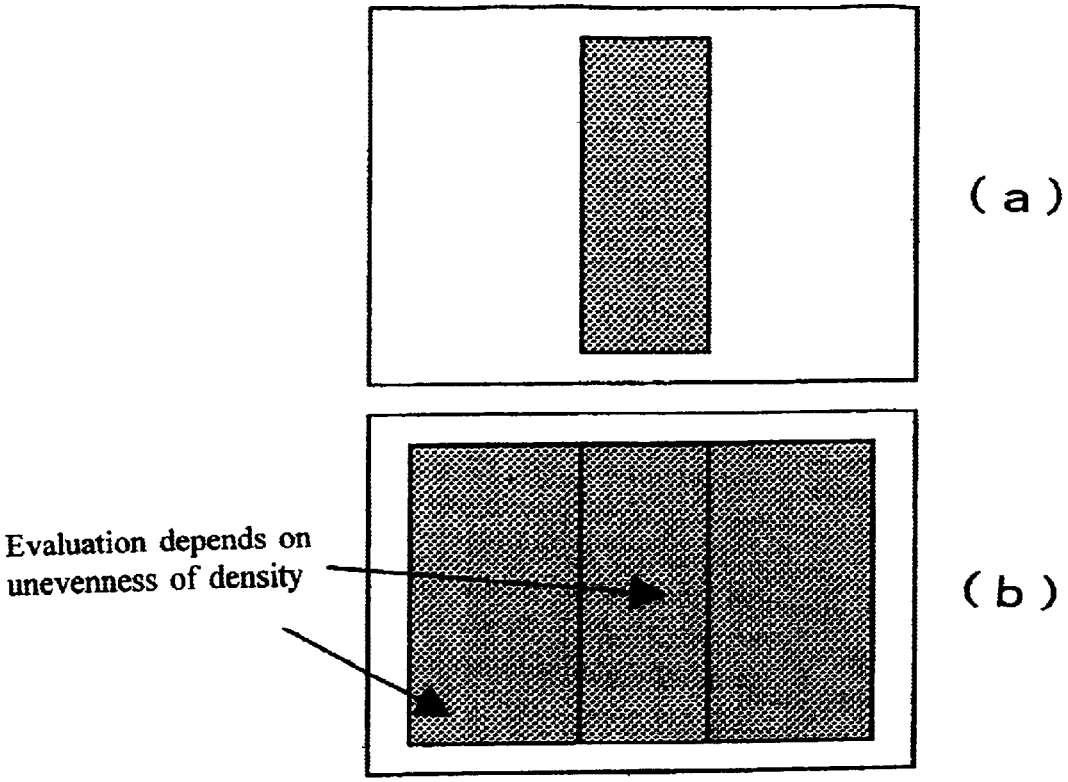
FIG. 10(*a*) is a view showing an image pattern used in experiments for measuring unevenness of density due to liberated CCA particles of toner, and FIG. 10(*b*) is a view showing a printed pattern used in the measuring experiments.

Actually, experiments for measurements of unevenness of density were conducted as for toners of Examples 3 and 4 and also toners of Comparative Example 3 for comparison to Examples 3 and 4. Synchronous and asynchronous particles of the CCA in each toner were measured by a particle analyzer and the liberation ratio "h" of the CCA was obtained from the above measurement. The respective values "e", "f", "g", and "h" of each toner are shown in Table 4. The experiments were conducted by a method as follows. An image pattern as shown in FIG. 10(*a*) was printed successively repeatedly to increase the consumption of the toner of the middle of the developing roller 16. In addition, an image pattern as shown in FIG. 10(*b*) was printed every 1000 sheets of paper. The unevenness of density, which may appear in a band shape, (hereinafter, called as "band-shaped unevenness") was observed for the evaluation of occurrence of image irregularities due to adherence of CCA.

The results of the experiments are shown in Table 4.

TABLE 4

| | e | f | g | h | Band-shaped Unevenness Appearance | Band-shaped Unevenness Evaluation |
|---|---|---|---|---|---|---|
| Example 3 | 5623 | 206 | 41 | 0.7% | None after printed 20000 sheets | ○ |
| Example 4 | 4270 | 502 | 49 | 1.0% | Little when printed 20000 sheets | ○ |
| Comparative Example 3 | 5131 | 228 | 76 | 1.4% | Existence when printed 5000 sheets | X |

As apparent from Table 4, the toner of Example 3, in which the liberation ratio "h" of liberated CCA is 0.7%, belonging to the present invention had a good result that no band-shaped unevenness appeared even after printed 20000 sheets of paper. The toner of Example 4, in which the liberation ratio "h" of liberated CCA is 1.0%, belonging to the present invention had a somewhat good result that little band-shaped unevenness appeared when printed 20000 sheets of paper and this unevenness was hard to be observed. The result says that the toner of Example 4 can be practically used. On the other hand, the toner of Comparative Example 3, in which the liberation ratio "h" of liberated CCA is 1.4%, not belonging to the present invention had no-good result that a band-shaped unevenness appeared when printed 5000 sheets of paper.

As apparent from the above results of the experiments, it is desired that the liberation ratio "h" of CCA as an additive of the toner T is set to be equal to or less than 1.0% which is the specified value corresponding to the CCA.

Now, description will be made as regard to as another embodiment of the toner T of the present invention. The toner T of this embodiment comprises, at least, mother particles 18 having a plurality of pigment particles, as the additive particles 19 shown in FIG. 9, entrapped and dispersed therein, mother particles 18' having no pigment particle therein, and pigment particles (hereinafter, sometimes called as "liberated pigment particles) liberated from any mother particle 18. In this toner T, the liberation ratio "h" of the liberated pigment particles, is set to be 0.6% or less.

In the toner T of this embodiment, the liberation ratio "h" of the liberated pigment particles is set to be 0.6% or less as mentioned above. Therefore, because of little liberated pigment particles, the probability of contact of liberated pigment particles with the surfaces of processing members including the developing roller 16 is small, thereby almost preventing the liberated pigment particles from adhering to the surfaces of the processing member including the developing roller 16. Therefore, the toner T of this embodiment can prevent occurrence of white blank in resultant images. Because the liberation ratio of the pigment is low, the influence of liberated pigment particles on the manifestation of color and permeability as the function of pigment is reduced, thus preventing the insufficiency of density, the insufficiency of permeability of OHP, and the like.

Actually, experiments for measurements of white blank and experiments for measurements of HAZE indicating the permeability were conducted as for toners of Examples 5 and 6 and also toners of Comparative Examples 4 through 6 for comparison to Examples 5 and 6. Each toner T used for the experiments was a toner in which copper phthalocyanine (Pig. Blue 15) was added as a cyan pigment in mother particles 18. In this case, synchronization and asynchronization between the mother particles and copper in the copper phthalocyanine were measured by a particle analyzer and the liberation ratio "h" of the cyan pigment was obtained from the above measurement. Assuming that the counted number of the mother particles 18 synchronized with the copper is "e", the counted number of the mother particles 18 not synchronized with the copper is "f", the counted number of the liberated copper particles is "g", and the liberation ratio of the cyan pigment is "h", the liberation ratio "h" of the cyan pigment is obtained by the same equation as the aforementioned case of CCA. The respective values "e", "f", "g", and "h" of each toner are shown in Table 5.

Figure 11:
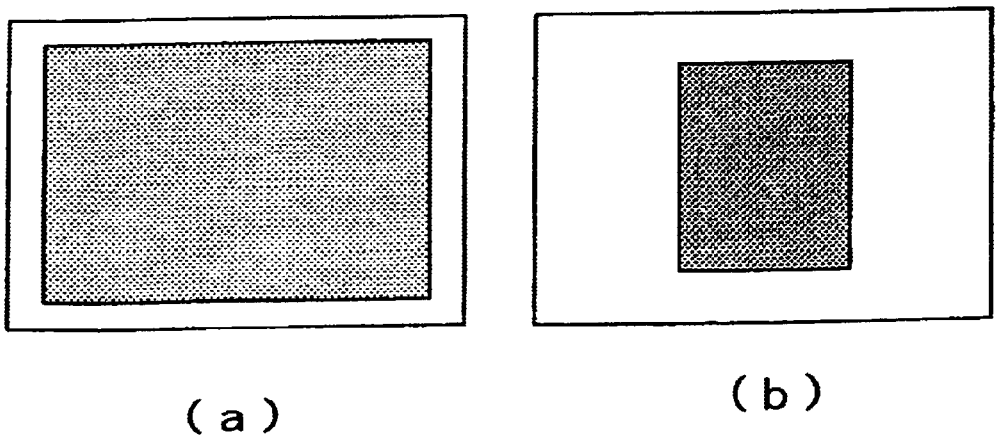
FIG. 11(*a*) is a view showing an image pattern, of which toner consumption ratio is 10%, and which is used in experiments for measuring image defects due to liberated pigment particles of toner, and FIG. 11(*b*) is a view showing a solid image used in experiments for measuring influence of liberated pigment particles on HAZE indicating the permeability.

The experiments were conducted by a method as follows. An image pattern of which toner consumption is 10% as shown in FIG. 11(*a*) was printed repeatedly and the number of a sheet of paper on which white blank due to adhesion of asynchronous particles of the cyan pigment adhering the deploying roller 16 appeared was measured. The evaluation was made according to the measured number of the sheet. In addition, an image pattern as shown in FIG. 11(*b*) was printed on a OHP sheet and HAZE indicating the permeability was measured. When the measured value was 20 or less, "good" was given for evaluation.

The results of the experiments are shown in Table 5.

TABLE 5

| | e | f | g | h | Occurrence of Image Defect Appearance | Occurrence of Image Defect Evaluation | HAZE Measured Value | HAZE Evaluation |
|---|---|---|---|---|---|---|---|---|
| Example 5 | 4541 | 52 | 19 | 0.4% | None after printed 20000 sheets | ○ | 14.6 | ○ |
| Example 6 | 6037 | 51 | 37 | 0.6% | None after printed 20000 sheets | ○ | 17.9 | ○ |
| Comparative Example 4 | 5596 | 44 | 41 | 0.7% | None after printed 20000 sheets | ○ | 21.3 | X |
| Comparative Example 5 | 4642 | 66 | 46 | 1.0% | Little when printed 20000 sheets | ○ | 25.6 | X |
| Comparative Example 6 | 5050 | 73 | 66 | 1.3% | Existence when printed 10000 sheets | X | 31.3 | X |

As apparent from Table 5, the toner of Example 5, in which the liberation ratio "h" of cyan pigment is 0.4%, belonging to the present invention had good results that no white blank appeared even after printed 20000 sheets of paper and that the measured value of HAZE was 14.6, i.e. lower than 20. The toner of Example 6, in which the liberation ratio "d" of cyan pigment is 0.6%, belonging to the present invention had good results that no white blank appeared even after printed 20000 sheets of paper and that the measured value of HAZE was 17.9, i.e. lower than 20.

On the other hand, the toner of Comparative Example 4, in which the liberation ratio "h" of cyan pigment is 0.7%, not belonging to the present invention had a good result that no white blank appeared even after printed 20000 sheets of paper, but no-good result that the measured value of HAZE was 21.3, i.e. exceeding 20. The toner of Comparative Example 5, in which the liberation ratio "h" of cyan pigment is 1.0%, not belonging to the present invention had no-good results that little white blank appeared when printed 20000 sheets of paper and that the measured value of HAZE was 25.6, i.e. exceeding 20. Further, The toner of Comparative Example 6, in which the liberation ratio "h" of cyan pigment is 1.3%, not belonging to the present invention had no-good results that the image defect of white blank appeared when printed 10000 sheets of paper and that the measured value of HAZE was 31.3, i.e. significantly exceeding 20.

As apparent from the above results of the experiments, it is desired that the liberation ratio "h" of cyan pigment as an additive of the toner T is set to be equal to or less than 0.6% which is the specified value corresponding to the cyan pigment.

As for variations of the toner T in which a magenta pigment which is a pigment different from the cyan pigment is added, the same experiments were conducted in the same manner as the aforementioned toners containing the cyan pigment. The toners T used for the experiments were toners of Examples 7 and 8 and toners of Comparative Examples 7 through 9 for comparison to Examples 7 and 8 as shown in Table 6. Each toner T was a toner in which carmin 6B (Pig. Red 57) was added as a magenta pigment in mother particles 18. In this case, the liberation "h" of magenta pigment can be obtained by measuring the synchronization and asynchronization between the mother particles and calcium in the carmin 6B. Therefore, the synchronization and asynchronization of the calcium were measured by a particle analyzer and the liberation ratio "h" of the magenta pigment was obtained from the above measurement. Assuming that the counted number of the mother particles 18 synchronized with the calcium is "e", the counted number of the mother particles 18 not synchronized with the calcium is "f", the counted number of the liberated calcium particles is "g", and the liberation ratio of the magenta pigment is "h", the liberation ratio "h" of the magenta pigment is obtained by the same equation as the aforementioned case of CCA. The respective values "e", "f", "g", and "h" of each toner are shown in Table 6. The experiments were conducted by the aforementioned method used for the case of cyan pigment.

The results of the experiments are shown in Table 6.

TABLE 6

| | | | | | Occurrence of Image Defect | | HAZE | |
|---|---|---|---|---|---|---|---|---|
| | e | f | g | h | Appearance | Evaluation | Measured Value | Evaluation |
| Example 7 | 4608 | 21 | 13 | 0.3% | None after printed 20000 sheets | ○ | 13.3 | ○ |
| Example 8 | 5580 | 65 | 27 | 0.5% | None after printed 20000 sheets | ○ | 16.9 | ○ |
| Comparative Example 7 | 6106 | 31 | 45 | 0.7% | None after printed 20000 sheets | ○ | 20.2 | Δ |
| Comparative Example 8 | 4748 | 64 | 55 | 1.0% | Little when printed 20000 sheets | ○ | 24.1 | X |
| Comparative Example 9 | 4917 | 66 | 59 | 1.2% | Existence when printed 14000 sheets | X | 28.2 | X |

As apparent from Table 6, the toner of Example 7, in which the liberation ratio "h" of magenta pigment is 0.3%, belonging to the present invention had good results that no white blank appeared even after printed 20000 sheets of paper and that the measured value of HAZE was 13.3, i.e. lower than 20. The toner of Example 8, in which the liberation ratio "h" of magenta pigment is 0.5%, belonging to the present invention had good results that no white blank appeared even after printed 20000 sheets of paper and the measured value of HAZE was 16.9, i.e. lower than 20.

On the other hand, the toner of Comparative Example 7, in which the liberation ratio "h" of magenta pigment is 0.7%, not belonging to the present invention had a good result that no white blank appeared even after printed 20000 sheets of paper, but no-good result that the measured value of HAZE was 20.2, i.e. exceeding 20. The toner of Comparative Example 8, in which the liberation ratio "h" of magenta pigment is 1.0%, not belonging to the present invention had a good result that little white blank appeared when printed 20000 sheets of paper because this blur was hard to be observed and the toner can be practically used. But the toner of Comparative Example 8 had no-good result that the measured value of HAZE was 24.1, i.e. exceeding 20. Further, the toner of Comparative Example 9, in which the liberation ratio "h" of magenta pigment is 1.2%, not belonging to the present invention had no-good results that the image defect of white blank appears when printed 14000 sheets of paper and that the measured value of HAZE was 28.2, i.e. significantly exceeding 20.

As apparent from the above results of the experiments, it is desired that the liberation ratio "h" of magenta pigment as an additive of the toner T is set to be equal to or less than 0.6% which is the specified value corresponding to the magenta pigment.

Now, description will be made as regard to as another embodiment of the toner T of the present invention.

The toner T of this embodiment comprises, at least, mother particles 18 having a plurality of metallic soap particles, as the additive particles 19 shown in FIG. 9, entrapped and dispersed therein, mother particles 18' having no metallic soap particle therein, and metallic soap particles (hereinafter, sometimes called as "liberated metallic soap particles) liberated from any mother particle 18. In this toner T, the liberation ratio "h" of the liberated metallic soap particles, is set to be 0.4% or less.

In the toner T of this embodiment, the liberation ratio "h" of the liberated metallic soap particles is set to be 0.4% or less as mentioned above. Therefore, because of little liberated metallic soap particles, the probability of contact of liberated metallic soap particles with the surfaces of processing members including the developing roller 16 is small, thereby almost preventing the liberated metallic soap particles from adhering to the surfaces of the processing member including the developing roller 16. Therefore, the toner T of this embodiment can prevent occurrence of image defects such as blurs.

Actually, experiments for measurements of blur were conducted as for toners of Examples 9 through 11 and also toners of Comparative Example 10 for comparison to Examples 9 through 11. Each toner T used for the experiments was a pulverized toner in which magnesium soap was added as the metallic soap in mother particles 18. In this case, synchronization and asynchronization between the mother particles and magnesium were measured by a particle analyzer and the liberation ratio "h" of the magnesium soap was obtained from the above measurement. Assuming that the counted number of the mother particles 18 synchronized with the magnesium is "e", the counted number of the mother particles 18 not synchronized with the magnesium is "f", the counted number of the liberated magnesium particles is "g", and the liberation ratio of the magnesium soap is "h", the liberation ratio "h" of the magnesium soap is obtained by the same equation as the aforementioned case of CCA. The respective values "e", "f", "g", and "h" of each toner are shown in Table 7. The experiments were conducted by a method as follows. An image pattern of which toner consumption is 10% as shown in FIG. 11(*a*) was printed repeatedly and the number of a sheet of paper on which blur due to adhesion of the magnesium soap on the developing roller 16 appeared was measured. The evaluation was made according to the measured number of the sheet.

The results of the experiments are shown in Table 7.

TABLE 7

| | e | f | g | h | Occurrence of Image Defect | |
|---|---|---|---|---|---|---|
| | | | | | Appearance | Evaluation |
| Example 9 | 6168 | 71 | 11 | 0.2% | None after printed 20000 sheets | ○ |
| Example 10 | 6854 | 66 | 21 | 0.3% | None after printed 20000 sheets | ○ |
| Example 11 | 6653 | 101 | 28 | 0.4% | Existence when printed 20000 sheets | Δ |
| Comparative Example 10 | 6373 | 87 | 34 | 0.5% | Existence when printed 9000 sheets | X |

As apparent from Table 7, the pulverized toner of Example 9, in which the liberation ratio "h" of magnesium soap is 0.2%, belonging to the present invention had a good result that no image defect of blur appeared even after printed 20000 sheets of paper. Similarly, the pulverized toner of Example 10, in which the liberation ratio "h" of magnesium soap is 0.3%, belonging to the present invention had a good result that no image defect of blur appeared even after printed 20000 sheets of paper. Further, the pulverized toner of Example 11, in which the liberation ratio "h" of magnesium soap is 0.4%, belonging to the present invention had somewhat good result that little blur appeared when printed 20000 sheets of paper and this blur was hard to be observed. The result says that the pulverized toner of Example 11 can be practically used.

On the other hand, the toner of Comparative Example 10, in which the liberation ratio "h" of magnesium soap is 0.5%, not belonging to the present invention had no-good result that an image defect of blur appeared when printed 9000 sheets of paper.

As apparent from the above results of the experiments, it is desired that the liberation ratio "h" of magnesium soap as an additive of the toner T is set to be equal to or less than 0.4% which is the specified value corresponding to the magnesium soap.

Now, description will be made as regard to as another embodiment of the toner T of the present invention.

The toner T of this embodiment is a polymerized toner and comprises, at least, mother particles 18 having a plurality of dispersant particles used for the polymerization reaction, as the additive particles 19 shown in FIG. 9, entrapped and dispersed therein, mother particles 18 having no dispersant particle therein, and dispersant particles (hereinafter, sometimes called as "liberated dispersant particles) liberated from any mother particle 18. In this toner T, the liberation ratio "h" of the liberated dispersant particles, is set to be 0.3% or less.

In the toner T of this embodiment, the liberation ratio "h" of the liberated dispersant particles is set to be 0.3% or less as mentioned above. Therefore, because of little liberated dispersant particles, the polymerized toner is hard to coagulate, thereby improving its fluidity. Therefore, predetermined toner carrying rate can be reliably obtained.

Actually, experiments for measurements of carrying rate were conducted as for polymerized toners of Examples 12 and 13 and also polymerized toners of Comparative Example 11 for comparison to Examples 12 and 13. Each toner T used for the experiments was a polymerized toner in which a dispersant was used as polymerization reaction assisting agent and higher saturated alcohol sodium ester sulfate was used as this dispersant. In this case, synchronization and asynchronization between the mother particles and sodium were measured by a particle analyzer and the liberation ratio "h" of residual dispersant was obtained from the above measurement. Assuming that the counted number of the mother particles 18 synchronized with the sodium is "e", the counted number of the mother particles not synchronized with the sodium is "f", the counted number of the liberated sodium particles is "g", and the liberation ratio of the residual dispersant is "h", the liberation ratio "h" of the residual dispersant is obtained by the same equation as the aforementioned case of CCA. The respective values "e", "f", "g", and "h" of each toner are shown in Table 8.

The experiments were conducted by a method as follows. The toner carrying rate was measured by entering the polymerized toner into a developing device and then driving the developing device. In this case, the measurement was conducted by a "tape transferring method" which comprising putting a tape on a carrying surface of the developing roller which carries the toner and striping the tape to transfer (move) the toner to the tape, and obtaining the carrying rate from the weight of the transferred toner and the area where the toner is peeled off by using the following equation:

Carrying rate=Weight of toner peeled off/Area of developing roller where toner is peeled off.

Since 0.33 or more of toner carrying rate is required for obtaining sufficient image density, "good" was given for evaluation when the measured value was 0.33 or more.

The results of the experiments are shown in Table 8.

TABLE 8

| | e | f | g | h | Carrying Rate | |
|---|---|---|---|---|---|---|
| | | | | | Measured Value | Evaluation |
| Example 12 | 4323 | 215 | 8 | 0.2% | 0.44 | ○ |
| Example 13 | 4734 | 116 | 14 | 0.3% | 0.33 | Δ |

TABLE 8-continued

| | e | f | g | h | Carrying Rate | |
|---|---|---|---|---|---|---|
| | | | | | Measured Value | Evaluation |
| Comparative Example 11 | 4661 | 177 | 18 | 0.4% | 0.28 | X |

As apparent from Table 8, the polymerized toner of Example 12, in which the liberation ratio "h" of sodium is 0.2%, belonging to the present invention had a good result that the measured value of the carrying rate was 0.44. The polymerized toner of Example 13, in which the liberation ratio "h" of sodium is 0.3%, belonging to the present invention had a somewhat good result that the measured value of the carrying rate was 0.33. The carrying rate indicated this value allows the toner to be practically used.

On the other hand, the toner of Comparative Example 11, in which the liberation ratio "h" of sodium is 0.4%, not belonging to the present invention had a no-good result that the measured value of the carrying rate was 0.28.

As apparent from the above results of the experiments, it is desired that the liberation ratio "h" of dispersant as an additive of the toner T is set to be equal to or less than 0.3% which is the specified value corresponding to the dispersant.

It should be understood that the present invention is not limited to the aforementioned additives and may be applied to any additive to be added to mother particles of toners. In this case, the liberation ratio of liberated additive particles is obtained by measurement of synchronization and asynchronization between the mother particles and the additive in the same manner as the respective embodiments. Using a particle analyzer for the synchronization and asynchronization between the mother particles and the additive allows easier and more accurate measurement.

Moreover, the present invention is not limited to the aforementioned image forming apparatus shown in FIG. 1 and FIG. 2(*a*) and may be applied to any image forming apparatus which can accept the toner T of the present invention.

As apparent from the above description, according to the toner of the present invention, the liberation ratio of librated additive is set to be equal to or less than a specified value corresponding to the additive, thereby restraining the amount of liberated additive liberated from mother particles. Therefore, the influence of the liberated additive on the carrying property and charging property of the toner can be reduced.

Particularly, according to the toner of the present invention, the liberation ratio "h" of liberated CCA is set to be 1.0% or less, thereby reducing adhesion of the liberated CCA to the surface of the developing roller. Even if a few particles of the liberated CCA particles adhere to the surface of the developing roller, the progress of adhering is slower and unevenness of density due to the adhesion of the liberated CCA particles to the surface of the developing roller is not conspicuous because the particle size of the CCA particles is significantly small in comparison to the particle size of the mother particles. Therefore, good images without unevenness due to the adhesion of the liberated CCA particles to the surface of the developing roller can be obtained over a relatively long period. The toner T of the present invention is particularly advantageous in an apparatus of which a developing device has a pressing means serving the developing roller and is extremely advantageous in a developing device employing a developing roller which is made of metal and is processed by blasting.

Further, according to the toner T of the present invention, the liberation ratio "h" of the liberated pigment particles is set to be 0.6% or less, thereby almost preventing the liberated pigment particles from adhering to the surfaces of the processing member including the developing roller. Therefore, the toner T of the present invention can prevent occurrence of white blank in resultant images and reduce the influence of liberated pigment particles on the manifestation of color and permeability as the function of pigment, thus preventing the insufficiency of density, the insufficiency of permeability of OHP, and the like.

Furthermore, according to the toner of the present invention, , the liberation ratio "h" of at least one of a mold releasing agent and a pulverization assisting agent which are liberated from mother particles is set to be 0.4% or less, thereby almost preventing the mold releasing agent or the pulverization assisting agent from adhering to the surfaces of the processing member including the developing roller. Therefore, the toner T of this embodiment can prevent occurrence of image defects such as blurs.

Moreover, according to the toner of the present invention, the liberation ratio "h" of the liberated polymerization reaction assisting agent is set to be 0.3% or less, thereby making the polymerized toner hard to coagulate and thus improving its fluidity. Therefore, predetermined toner carrying rate can be reliably obtained.

On the other hand, according to the image forming apparatus of the present invention, the aforementioned toner of the present invention is used, thereby preventing liberated additive from adhering to the surfaces of the processing member including the developing roller. Therefore, the image forming apparatus of the present invention can improve the lifetime of the developing device and can provide good images over a long period.

I claim:

1. A toner comprising, at least, a plurality of mother particles and a plurality of additives which are contained in the mother particles, said toner having a liberation ratio of liberated additives liberated from said mother particles which is set to be equal to or less than a specified value corresponding to the additives, wherein a CCA and a pigment are used as said additives and the liberation ratio of the liberated CCA is set to be 1.0% or less.

2. A toner as claimed in claim 1, wherein the liberation ratio of the mother particles in which the CCA is not contained is set to be 3.0% or less.

3. A toner as claimed in claim 1, wherein the liberation ratio of the liberated pigment is set to be 0.6% or less.

4. A toner as claimed in claim 1, wherein the toner is a pulverized toner prepared by pulverization, and that at least one of a mold releasing agent and a pulverization assisting agent is used as one of said additives and the liberation ratio of the at least one of the mold releasing agent and the pulverization assisting agent liberated from the mother particles is set to be 0.4% or less.

5. A toner as claimed in claim 1, wherein the toner is a polymerized toner prepared by polymerization, and that at least one of an initiator and dispersant to be added for polymerization reaction is used as one of said additives and the liberation ratio of the at least one of the initiator and the dispersant from the mother particles is 0.3% or less.

6. An image forming apparatus comprising:

a latent image carrier on which an electrostatic latent image is formed; and a developing device having a conductive developing roller for carrying a toner to develop the electrostatic latent image on said latent image carrier, and a toner regulating means for regulating the toner to be carried toward said latent image carrier and charging said toner, wherein said toner includes at least a plurality of mother particles and a plurality of additives which are contained in the mother particles, said toner having a liberation ratio of liberated additives liberated from said mother particles that is set to be equal to or less than a specified value corresponding to the additives, and wherein a CCA and a pigment are used as said additives and the liberation ratio of the liberated CCA is set to be 1.0% or less.

7. An image forming apparatus as claimed in claim 6, wherein the liberation ratio of the mother particles in which the CCA is not contained is set to be 3.0% or less.

8. An image forming apparatus as claimed in claim 6, wherein the liberation ratio of the liberated pigment is set to be 0.6% or less.

9. An image forming apparatus as claimed in claim 6, wherein the toner is a pulverized toner prepared by pulverization, and that at least one of a mold releasing agent and a pulverization assisting agent is used as one of said additives and the liberation ratio of the at least one of the mold releasing agent and the pulverization assisting agent liberated from the mother particles is set to be 0.4% or less.

10. An image forming apparatus as claimed in claim 6, wherein the toner is a polymerized toner prepared by polymerization, and that at least one of an initiator and a dispersant to be added for polymerization reaction is used as one of said additives and the liberation ratio of the at least one of the initiator and the dispersant from the mother particles is 0.3% or less.

11. An image forming apparatus as claimed in claim 6, wherein the liberation ratio of liberated additives liberated from said mother particles is set to be equal to or less than a specified value corresponding to the additives, and wherein the liberation ratio of the liberated pigment is set to be 0.6% or less.

12. A toner comprising, at least, a plurality of mother particles and a plurality of additives which are contained in the mother particles, said toner having a liberation ratio of liberated additives liberated from said mother particles which is set to be equal to or less than a specified value corresponding to the additives, wherein a pigment is used as one of said additives and the liberation ratio of the liberated pigment is set to be 0.6% or less.

13. A toner as claimed in claim 12, wherein the toner is a pulverized toner prepared by pulverization, and that at least one of a mold releasing agent and a pulverization assisting agent is used as one of said additives and the liberation ratio of the at least one of the mold releasing agent and the pulverization assisting agent liberated from the mother particles is set to be 0.4% or less.

14. A toner as claimed in claim 12, wherein the toner is a polymerized toner prepared by polymerization, and that at least one of an initiator and a dispersant to be added for polymerization reaction is used as one of said additives and the liberation ratio of the at least one of the initiator and the dispersant from the mother particles is 0.3% or less.

* * * * *